US008302845B2

(12) United States Patent
Bell et al.

(10) Patent No.: US 8,302,845 B2
(45) Date of Patent: Nov. 6, 2012

(54) SHIPPER DISPLAY CONTAINER

(75) Inventors: Jackie E. Bell, Racine, WI (US); Scott M. Miller, Trenton, OH (US)

(73) Assignee: Packaging Corporation of America, Lake Forest, IL (US)

( * ) Notice: Subject to any disclaimer, the term of this patent is extended or adjusted under 35 U.S.C. 154(b) by 267 days.

(21) Appl. No.: 12/719,574

(22) Filed: Mar. 8, 2010

(65) Prior Publication Data

US 2010/0224675 A1 Sep. 9, 2010

Related U.S. Application Data

(60) Provisional application No. 61/158,606, filed on Mar. 9, 2009.

(51) Int. Cl.
*B65D 5/54* (2006.01)

(52) U.S. Cl. ..... 229/103; 229/240; 206/736

(58) Field of Classification Search ..... 229/103; 206/774, 736, 738, 139, 161, 175, 192; 40/312
See application file for complete search history.

(56) References Cited

U.S. PATENT DOCUMENTS

| | | | | |
|---|---|---|---|---|
| 1,186,920 | A | 6/1916 | Ledbetter | |
| 1,649,211 | A | 11/1927 | Bitzer | |
| 2,018,707 | A | 10/1935 | Daller | 229/51 |
| 2,450,035 | A | 9/1948 | De Mian | 229/34 |
| 2,797,040 | A | 6/1957 | Belsinger | 229/37 |
| 2,942,770 | A | 6/1960 | Eichorn | 229/33 |
| 2,955,734 | A | 10/1960 | Barton | 229/16 |
| 2,983,424 | A | 5/1961 | Glass | 229/27 |
| 3,079,058 | A | 2/1963 | Russell | 229/6 |
| 3,111,254 | A | 11/1963 | Thyen | 229/44 |
| 3,241,737 | A | 3/1966 | Steinbock | 229/17 |
| 3,533,549 | A | 10/1970 | Gilchrist | 229/51 |
| 3,669,341 | A | 6/1972 | Hughes | 229/33 |
| 3,820,706 | A | 6/1974 | Gibson et al. | 229/34 |
| 3,863,829 | A | 2/1975 | Merrill | 229/16 |
| 3,863,831 | A | 2/1975 | Wozniacki et al. | 229/23 |
| 3,871,570 | A | 3/1975 | Garmon | 229/31 |
| 3,881,648 | A | 5/1975 | Hall | 229/6 |
| 3,910,484 | A | 10/1975 | Wozniacki | 229/34 |
| 3,940,053 | A | 2/1976 | Putman et al. | 229/34 |
| 3,961,706 | A | 6/1976 | Roccaforte et al. | 206/44 |
| 4,053,098 | A | 10/1977 | Baptist | 229/23 |
| 4,053,100 | A | 10/1977 | Baptist | 229/43 |

(Continued)

FOREIGN PATENT DOCUMENTS

EP 0529260 A2 7/1992

(Continued)

*Primary Examiner* — Gary Elkins
*Assistant Examiner* — Christopher Demeree
(74) *Attorney, Agent, or Firm* — Nixon Peabody LLP

(57) ABSTRACT

A container comprises a front panel including a stationary front portion and a removable front portion separated by a first line of weakness. The container comprises a rear panel including a stationary and a detachable rear portion separated by a second line of weakness. The container comprises a first and an opposing second side panel separated from the removable front portion by third and fourth lines of weakness. The container comprises a top front major flap extending from the removable front portion and hingedly coupled to the removable front portion by a first fold line. The container comprises a top rear major flap extending from the rear panel and hingedly coupled to the stationary rear portion and the detachable rear portion by a second fold line. The container is configured to be converted into a display configuration.

20 Claims, 6 Drawing Sheets

U.S. PATENT DOCUMENTS

| | | | | | |
|---|---|---|---|---|---|
| 4,053,101 | A | | 10/1977 | Hart, Jr. | 229/36 |
| 4,082,215 | A | | 4/1978 | Eichenauer | 229/36 |
| 4,101,048 | A | | 7/1978 | Rieben et al. | 229/34 |
| 4,103,819 | A | | 8/1978 | Muise | 229/33 |
| 4,113,100 | A | * | 9/1978 | Soja et al. | 229/112 |
| 4,117,929 | A | | 10/1978 | VanderMey | 206/326 |
| 4,121,753 | A | | 10/1978 | Westfall | 229/37 |
| 4,151,948 | A | | 5/1979 | de la Fuente, Jr. | 229/34 |
| 4,170,297 | A | | 10/1979 | Johnson | 206/326 |
| 4,171,762 | A | | 10/1979 | Matthews | 229/15 |
| 4,175,691 | A | | 11/1979 | Cornell et al. | 229/36 |
| 4,185,741 | A | | 1/1980 | Schiff et al. | 206/326 |
| 4,191,288 | A | | 3/1980 | Hostad | 206/45.22 |
| 4,228,898 | A | | 10/1980 | Zeitter et al. | 206/621 |
| 4,234,081 | A | | 11/1980 | Champlin | 206/147 |
| 4,284,195 | A | | 8/1981 | Champlin | 206/427 |
| 4,291,830 | A | | 9/1981 | Sorensen | 229/45 |
| 4,300,680 | A | | 11/1981 | Champlin | 206/427 |
| 4,304,351 | A | | 12/1981 | Stollberg | 229/23 |
| 4,318,474 | A | | 3/1982 | Hasegawa | 206/428 |
| 4,324,328 | A | | 4/1982 | Champlin | 206/194 |
| 4,335,843 | A | | 6/1982 | Kent | 229/27 |
| 4,347,969 | A | | 9/1982 | Kost et al. | 229/34 |
| 4,349,147 | A | | 9/1982 | Jensen | 229/34 |
| 4,350,281 | A | | 9/1982 | Dornbusch et al. | 229/38 |
| 4,382,504 | A | | 5/1983 | Vesborg | 206/44 |
| 4,385,721 | A | | 5/1983 | Olsen et al. | 229/32 |
| 4,391,405 | A | | 7/1983 | Drinon | 229/31 |
| 4,394,905 | A | | 7/1983 | Hackenberg | 206/486 |
| 4,418,863 | A | | 12/1983 | Kimbrell, Sr. | 229/49 |
| 4,441,649 | A | | 4/1984 | Nederveld | 229/38 |
| 4,511,080 | A | | 4/1985 | Madsen et al. | 229/41 |
| 4,537,344 | A | | 8/1985 | Thomas | 229/34 |
| 4,542,847 | A | | 9/1985 | Lindstrom | 229/16 |
| 4,565,316 | A | | 1/1986 | Jes | 229/23 |
| 4,567,996 | A | | 2/1986 | Muise | 220/416 |
| 4,570,790 | A | | 2/1986 | Turnage | 206/263 |
| 4,600,142 | A | | 7/1986 | Quaintance | 229/143 |
| 4,613,045 | A | | 9/1986 | Watson | 206/512 |
| 4,645,122 | A | | 2/1987 | Nederveld | 229/45 |
| 4,676,429 | A | | 6/1987 | Crowe et al. | 229/109 |
| 4,753,341 | A | | 6/1988 | McIntyre | 206/45 |
| 4,770,339 | A | | 9/1988 | Weimer | 229/143 |
| 4,787,515 | A | | 11/1988 | Stoll | 206/509 |
| 4,852,756 | A | | 8/1989 | Holladay | 220/4 |
| 4,860,886 | A | * | 8/1989 | Northrup et al. | 206/45.29 |
| 4,866,232 | A | | 9/1989 | Stone | 219/10.55 |
| 4,871,067 | A | | 10/1989 | Valenti | 206/427 |
| 4,883,221 | A | | 11/1989 | Brundage | 229/143 |
| 4,884,739 | A | | 12/1989 | Nederveld | 229/109 |
| 4,884,741 | A | | 12/1989 | Nederveld | 229/157 |
| 4,946,093 | A | | 8/1990 | Moorman | 229/128.19 |
| 4,949,898 | A | | 8/1990 | Nederveld | 229/117.02 |
| 4,958,734 | A | | 9/1990 | Wood et al. | 206/435 |
| 4,969,559 | A | | 11/1990 | Nederveld | 206/600 |
| 5,000,377 | A | | 3/1991 | McClure | 229/154 |
| 5,002,224 | A | | 3/1991 | Muise | 229/169 |
| 5,035,330 | A | | 7/1991 | Kuchenbecker | 206/621.4 |
| 5,052,615 | A | | 10/1991 | Ott et al. | 229/182 |
| 5,106,013 | A | | 4/1992 | Southwell et al. | 229/40 |
| 5,125,567 | A | | 6/1992 | McClure | 229/150 |
| 5,139,196 | A | | 8/1992 | Fry et al. | 229/157 |
| 5,163,609 | A | | 11/1992 | Muise, Jr. | 229/113 |
| 5,167,324 | A | * | 12/1992 | Miller | 206/738 |
| 5,261,594 | A | | 11/1993 | Brown et al. | 229/191 |
| 5,263,612 | A | | 11/1993 | Nederveld | 229/112 |
| 5,277,360 | A | | 1/1994 | DeMott | 229/122 |
| 5,285,731 | A | | 2/1994 | McIntyre | 108/51.3 |
| 5,285,956 | A | | 2/1994 | Piepho | 229/191 |
| 5,289,970 | A | | 3/1994 | McClure | 229/143 |
| 5,294,044 | A | | 3/1994 | Clark | 229/191 |
| 5,330,094 | A | | 7/1994 | Mertz | 229/167 |
| 5,350,111 | A | | 9/1994 | Vosbikian | 229/162 |
| 5,361,975 | A | | 11/1994 | Droste et al. | 229/120.34 |
| 5,361,976 | A | | 11/1994 | Blomfield | 229/148 |
| 5,370,303 | A | | 12/1994 | Fry | 229/143 |
| 5,386,937 | A | | 2/1995 | Crawford | 229/138 |
| 5,392,985 | A | | 2/1995 | Smith et al. | 229/125 |
| 5,413,276 | A | | 5/1995 | Sheffer | 229/120.11 |
| 5,429,296 | A | | 7/1995 | Southwell et al. | 229/168 |
| 5,458,272 | A | | 10/1995 | Ward-Weber | 229/122.1 |
| 5,458,283 | A | | 10/1995 | Southwell et al. | 229/178 |
| 5,516,034 | A | | 5/1996 | Jensen et al. | 229/120 |
| 5,524,815 | A | | 6/1996 | Sheffer | 229/120.18 |
| 5,535,941 | A | | 7/1996 | Garza | 229/191 |
| 5,622,309 | A | | 4/1997 | Matsuda et al. | 229/243 |
| 5,649,663 | A | | 7/1997 | Pestow, Jr. | 229/190 |
| 5,657,872 | A | | 8/1997 | Leftwich et al. | 206/738 |
| 5,673,848 | A | | 10/1997 | Garza | 229/191 |
| 5,687,902 | A | | 11/1997 | Tusing et al. | 229/198.1 |
| 5,704,193 | A | | 1/1998 | Roe et al. | 53/397 |
| 5,729,960 | A | | 3/1998 | Davis | 53/458 |
| 5,860,590 | A | | 1/1999 | Blomfield et al. | 229/165 |
| 5,938,108 | A | | 8/1999 | Williams et al. | 229/109 |
| 5,941,452 | A | | 8/1999 | Williams et al. | 229/109 |
| 5,950,914 | A | | 9/1999 | Dunton et al. | 229/122 |
| 5,957,294 | A | | 9/1999 | Kanter | 206/744 |
| 6,047,646 | A | | 4/2000 | Gugel | 108/51.3 |
| 6,168,027 | B1 | | 1/2001 | Esser | 206/738 |
| 6,189,778 | B1 | | 2/2001 | Kanter | 229/122.1 |
| 6,189,780 | B1 | | 2/2001 | Kanter | 229/242 |
| 6,223,978 | B1 | | 5/2001 | Drager | 229/109 |
| 6,286,753 | B1 | | 9/2001 | Jackson et al. | 229/174 |
| 6,302,323 | B1 | | 10/2001 | Southwell | 229/164 |
| 6,375,068 | B2 | | 4/2002 | Jackson et al. | 229/174 |
| 6,481,619 | B1 | | 11/2002 | Jackson | 229/169 |
| 6,581,772 | B2 | | 6/2003 | Noland | 206/509 |
| 6,604,675 | B2 | | 8/2003 | Southwell | 229/164 |
| 6,676,012 | B1 | | 1/2004 | Southwell et al. | 229/120.17 |
| 7,080,736 | B2 | | 7/2006 | Jackson et al. | 206/738 |
| 7,081,077 | B2 | | 7/2006 | Southwell et al. | 493/68 |
| 2002/0043554 | A1 | * | 4/2002 | White et al. | 229/235 |
| 2003/0010816 | A1 | | 1/2003 | Jackson | 229/169 |
| 2005/0184139 | A1 | * | 8/2005 | Gasior | 229/240 |

FOREIGN PATENT DOCUMENTS

| | | | | |
|---|---|---|---|---|
| FR | 2728867 | A1 | | 12/1994 |
| GB | 2245542 | A | | 1/1992 |
| JP | 10236468 | A | * | 9/1998 |
| JP | 10-310130 | | | 11/1998 |
| WO | WO 99/43560 | | | 9/1999 |

* cited by examiner

SHIPPER DISPLAY CONTAINER

CROSS-REFERENCE TO RELATED APPLICATION

This application claims the benefit of U.S. Provisional Application No. 61/158,606, filed Mar. 9, 2009, which is hereby incorporated by reference in their entirety.

FIELD OF THE INVENTION

The present invention relates generally to containers for retaining, shipping, and displaying goods and methods for making such containers. In particular, the present invention relates to a shipper display container.

BACKGROUND OF THE INVENTION

Flat sheets of corrugated paperboard, typically referred to as blanks, have been used for many years as the starting material to form containers. Corrugated paperboard generally refers to a multi-layer sheet material comprised of two sheets of liner bonded to a central corrugated layer of medium. A basic size requirement is generally specified by the customer, industry standards, and the preference for low cost, paperboard containers. Thus, manufacturers strive to provide structural stacking strength with a minimal amount of corrugated paperboard. A typical well-known container is a single-piece tray design having a bottom wall, two side walls, and two end walls each hinged to the bottom wall. Typically, a single piece of corrugated paperboard will be cut and scored to form a flat blank that will then be erected into this type of container.

One type of container—a regular slotted container (RSC)—is typically used for packing, storing, and shipping goods. Existing RSCs include flaps that are generally same length. The outer flaps usually meet, and the inner flaps meet on square containers. RSCs may have a glued, taped, or stitched corner seam. The flute direction usually runs parallel to the depth of the container, which assists in providing increased stacking strength.

One drawback to existing RSC containers is that they are intended for shipping products to and from a manufacturer and the end point and are then discarded as dunnage.

Another disadvantage of existing RSC containers is that they are not for display purposes. Thus, the contents must often be transferred out of the RSC container and into a separate display container or area.

Thus, it would be desirable to provide a shipper display container that addresses one or more of the above disadvantages.

SUMMARY OF THE INVENTION

According to one embodiment of the present invention, a container is disclosed. The container comprises a front panel including a stationary front portion and a removable upper portion. The stationary front portion is separated from the removable upper portion by a first line of weakness. The container further comprises a rear panel including a stationary rear portion and a detachable rear portion. The stationary rear portion is separated from the detachable rear portion by a second line of weakness. The container further comprises a first side panel and an opposing second side panel. The first and second side panels bridge the front panel and the rear panel. The first and second side panels are separated from the removable upper portion by respective third and fourth lines of weakness. The container further comprises a top front major flap extending from the removable upper portion. The top front major flap is hingedly coupled to the removable upper portion by a first fold line. The container further comprises a top rear major flap extending from the rear panel. The top rear major flap is hingedly coupled to the stationary rear portion and the detachable rear portion by a second fold line. The container is configured to be converted into a display configuration in which the removable upper portion and the top front major flap are removed from the container, the top rear major flap is generally flush with an interior surface of the stationary rear portion of the rear panel, and the detachable rear portion of the rear panel is rotated about the second fold line into a position generally coplanar with the stationary rear portion.

According to another embodiment of the present invention, a container is disclosed. The container comprises a front panel, a rear panel, first and second side panels bridging the front panel and the rear panel, a top front flap extending from the front panel, and a top rear flap extending from the rear panel. The container further comprises a removable portion including an upper section of the front panel and the top front flap. The removable portion is separable from the container along at least one lines of weakness. The container further comprises a display portion including a detachable portion of the rear panel. The detachable portion is separable from the rear panel by at least one line of weakness and being hingedly coupled to the top rear flap.

According to one process of the present invention, a method of using a container is disclosed. The method comprises the act of providing a container including a front panel, a rear panel, a first side panel, and an opposing second side panel bridging the front panel and the rear panel, a top front major flap, and a top rear major flap. The front panel includes a stationary front portion and a removable upper portion. The stationary front portion is separated from the removable upper portion by a first line of weakness, the rear panel includes a stationary rear portion and a detachable rear portion. The stationary rear portion is separated from the detachable rear portion by a second line of weakness. The first and second side panels are separated from the removable upper portion by respective third and fourth lines of weakness. The top front major flap extends from the removable upper portion. The top front major flap is hingedly coupled to the removable upper portion by a first fold line. The top rear major flap extends from the rear panel, the top rear major flap is hingedly coupled to the stationary rear portion and the detachable rear panel by a second fold line. The method further comprises the act of converting the container from a shipper configuration to a display configuration by removing the upper front portion and the top front major panel along the first line of weakness, detaching the detachable rear portion along the second line of weakness, rotating the top rear major flap toward the interior of the container along the second fold line such that the top rear major flap is generally flush with an interior side of the stationary rear portion, and rotating the detachable rear portion about the second fold line such that the detachable rear portion is generally coplanar with the stationary rear portion.

The above summary of the present invention is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
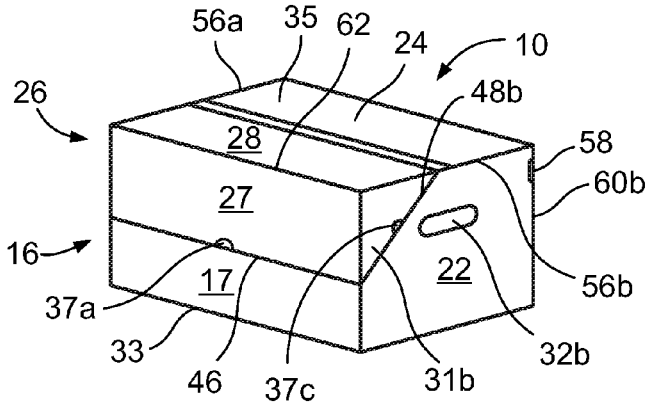
FIG. 1*a* is a top perspective view of a front of shipper display container in a shipper configuration according to one embodiment of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Figure 1B:
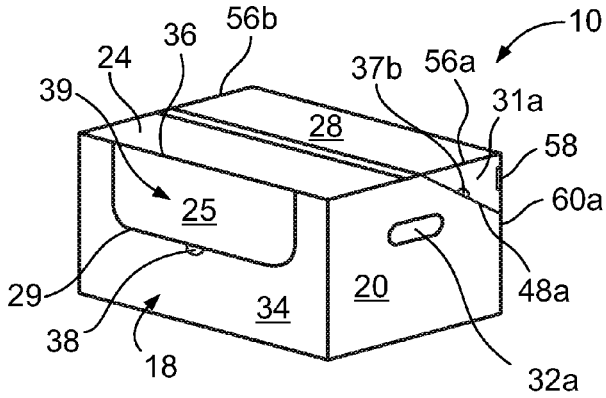
FIG. 1*b* is a top perspective view of a back of the shipper display container of FIG. 1*a*.

Turning now to FIGS. 1*a*, 1*b*, a non-limiting example of a shipper display container 10 according one embodiment of the present invention is shown. The container 10 is adapted to store and ship a plurality of items intended for sale from a manufacturer to a retail location. Once the container 10 arrives at the retail location, the container 10 may be converted into a display configuration so that the items may be displayed, dispensed, and sold to a consumer. The container 10 is adapted for easy conversion from a shipper configuration to a display and dispensing configuration. The container 10 is adapted to be placed on a counter top or on shelving at an appropriate height. The container 10 may also be stacked on top of other containers, structures, or the like.

According to one embodiment of the present invention, the container 10 of FIGS. 1*a*, 1*b* comprises a front panel 16, a rear panel 18, a first side panel 20, a second side panel 22, and a top rear major flap 24. The front panel 16 includes a stationary front portion 17 and a removable front portion 27. The top rear major flap 24 includes at least one tab 54 (see FIGS. 2-4) positioned on at least one side 56 thereof. The container 10 also includes at least one opposing slot 58 positioned along at least one respective fold line 60*b* separating the rear panel 18 from the respective first and second side panels 20, 22. The rear panel 18 includes a stationary rear portion 34 and a detachable rear portion 39 (see FIG. 1B, 5B) including a signage panel 25. The signage panel 25 is separated from the stationary portion 34 by at least one line of weakness 29. The lines of weakness described herein may include perforation, scored lines, cut lines, tear lines, reverse cut, combinations thereof, or the like. The rear panel 18 further includes a notch 38 positioned adjacent to the signage panel 25.

The container 10 further includes a removable portion 26 including the removable front portion 27, a top front major flap 28, first and second top minor flaps 30*a*, 30*b* (see FIGS. 2, 3), and first and second diagonal portions 31*a*, 31*b*. The diagonal portions 31*a*, 31*b* are separated from the respective side panels 20, 22 by lines of weakness 48*a*, 48*b*. In another embodiment, the container 10 does not include first and second minor flaps 30*a*, 30*b*. In yet another embodiment, the container 10 does not include diagonal portions 31*a*, 31*b*.

The removable front portion 27 and the first and second diagonal portions 31*a*, 31*b* include respective notches 37*a*-*c* positioned along the edges thereof. Although the notches 37*a*-*c* of the illustrated embodiment are semi-circular in shape, it is contemplated that the notches 37*a*-*c* may include any suitable shape and may be positioned anywhere along the edges of one or more of the removable front portion 27 and the first and second diagonal portions 31*a*, 31*b*.

The top front major flap 28, the top rear major flap 24, and the first and second top minor flaps 30*a*, 30*b* form a top 35 of the container. A bottom 33 of the container 10 also includes one or more bottom flaps (see flaps 68*a*-*d* of FIG. 8) positioned opposite the top major flaps 24, 28 and first and second top minor flaps 30*a*, 30*b*.

The top rear major flap extends 24 extends from the rear panel 18 and is separated therefrom by a score 36. The top front major flap 28 extends from the removable front portion 27 and is separated therefrom by a fold line 62. The first and second top minor flaps 30*a*, 30*b* extend from the first and second side panels 20, 22, respectively and are attached (e.g., via adhesive) to the top front major flap 28. Lines of weakness 45 (see FIG. 2) separate the first and second top minor flaps 30*a*, 30*b* from the first and second side panels 20, 22. A line of weakness 46 separates the removable front portion 27 from the stationary front portion 17.

In the shipper configuration of FIGS. 1*a*-6*b*, the first and second side panels 20, 22 include two openings 32*a*, 32*b* to allow a user to grasp the side panels 20, 22. The openings 32*a*, 32*b* may include notches, slits, or the like. Portions of the first and second side panels 20, 22 may be die cut such that the die cut portions are adapted to be folded along a hinge or score thereby forming the openings 32*a*, 32*b* of the container 10.

The assembled container 10 of FIGS. 1*a*, 1*b* may be produced on, for example, a Flexo™ Folder Gluer of Marquip-WardUnited (Phillips, Wis.). The container 10 may be hand-assembled or assembled automatically using, for example, an automatic case erector. The top 35 and the bottom 33 of the container 10 may be formed by taping and/or gluing the respective flaps (e.g., flaps 24, 28, 30*a*, 30*b* of the top 35) in a closed position.

Figure 2:
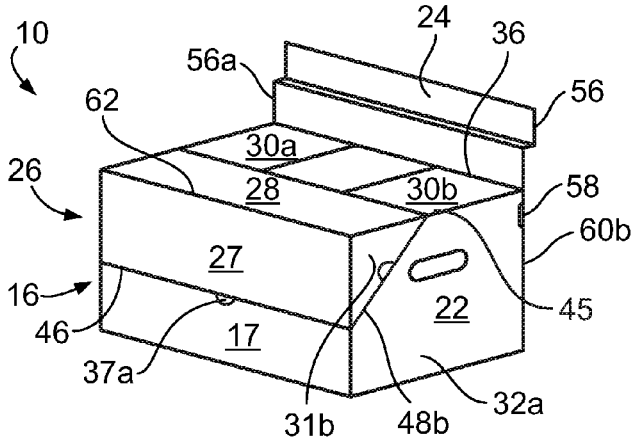
FIGS. 2-6*b* are top perspective views of the container of FIGS. 1*a*-*b* being converted from a shipper configuration to a display configuration.
Figure 3:
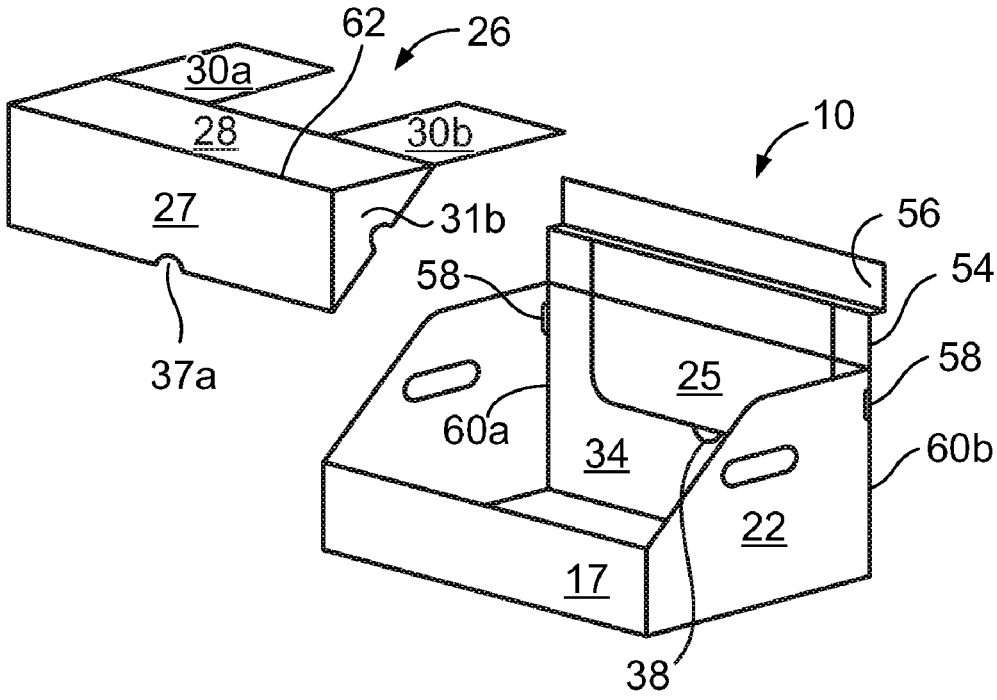
Figure 5A:
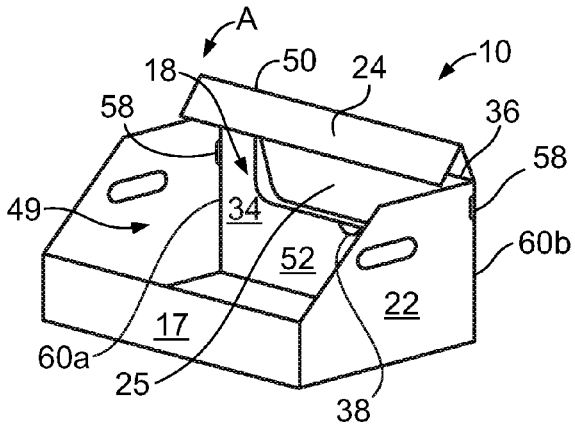
Figure 5B:
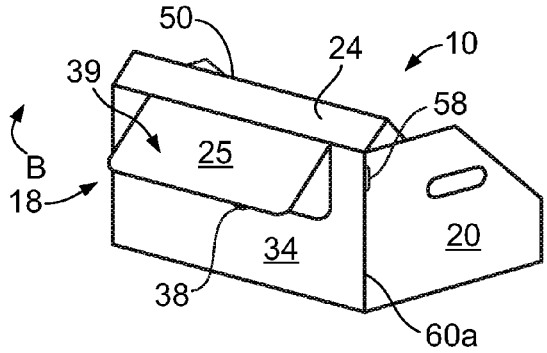
Figure 6A:
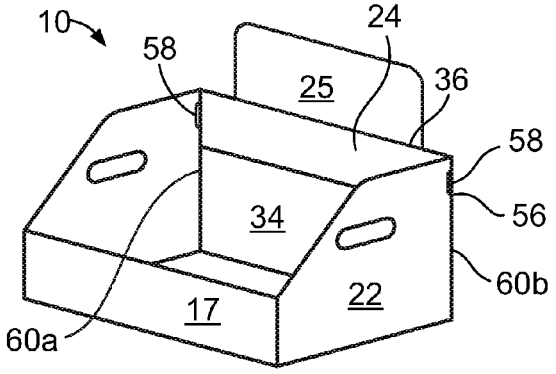
Figure 6B:
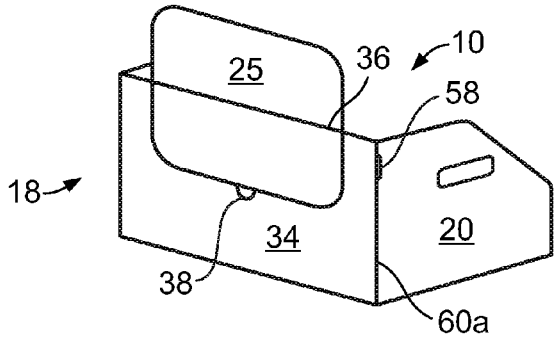

FIGS. 2-6*b* show the container 10 of FIGS. 1*a,b* being converted from a shipper configuration shown in FIGS. 1*a,b* to a display configuration (FIGS. 6*a*, 6*b*). Referring to FIG. 2, for example, the top rear major flap 24 is unfolded along the score 36. As shown in FIG. 3, a user may use one or more of the notches 37*a*-*c* to break the lines of weakness 46, 48*a*, 48*b* and lift the removable portion 26 away from the remaining portion of the container 10. Tabbed tear tape or sesame tape could be used as an alternative to the notches on panels 27, 17, 25, 18 to replace lines of weakness 46 and 29. It is contemplated that other methods may be used to remove the removable portion 26.

Figure 4:
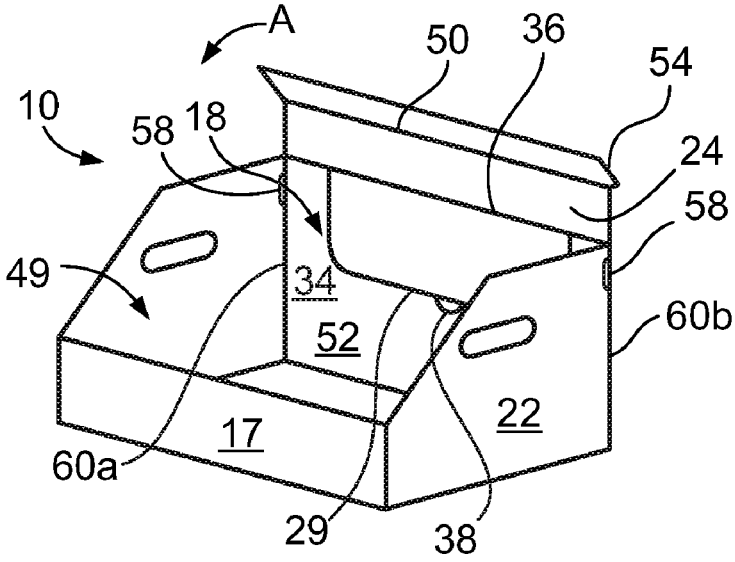

As shown in FIG. 4, the top rear major flap 24 is then folded in the direction of Arrow A toward an interior 49 of the container 10 along a score 50 running generally parallel to the score 36. Although the score 50 of the illustrated embodiments generally divides the top rear major flap 24 in half, the score 50 may, alternatively, divide the top rear major flap 24 into uneven sections.

Referring to FIGS. 5*a*, 5*b*, the top rear major flap 24 may then be folded along the fold line 36 and tucked into the interior 49 of the container 10 such that the top rear major flap 24 is generally flush with an interior side 52 of the rear panel 18. Thus, when the container 10 includes a product (e.g., food, beverages, automotive goods, hard or soft products, or the like), the top rear major flap 24 would be positioned behind the product (see FIGS. 7*a*, 7*b*). The signage panel 25 is then unfolded outwardly from the container 10 in the direction of Arrow B (FIG. 5B) along score 36 by grasping and pulling the signage panel 25 via the notch 38 (e.g., by placing one or more fingers into the notch 38) and breaking the lines of weakness 29 (see FIG. 4). The signage panel 25 remains attached to the container 10 along the score 36. As the top rear major flap 24 is folded into the container 10, the signage panel 25 is semi-automatically lifted into an upright position by virtue of being attached to the top rear major flap 24 via the fold line 36.

Figure 7A:
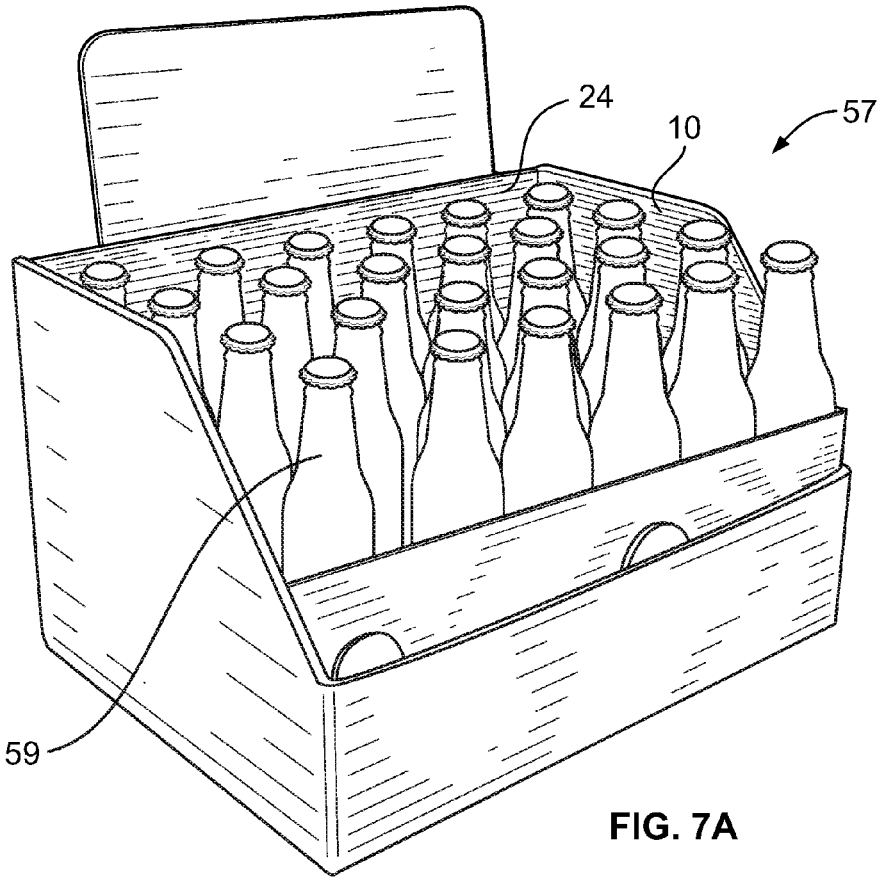
FIG. 7*a* is a top perspective view of a front of a shipper display container in a display configuration.
Figure 7B:
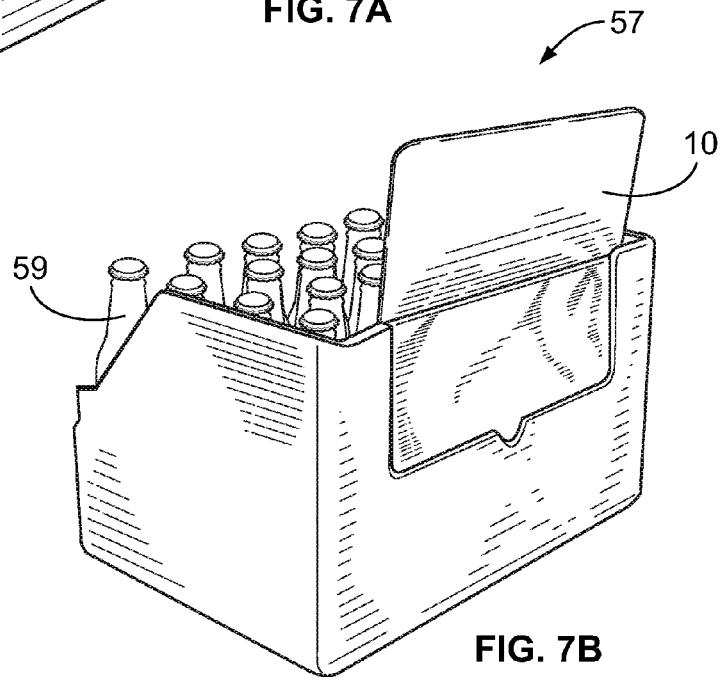
FIG. 7*b* is a top perspective view of a back of a shipper display container in a display configuration.

Turning now to FIGS. 6*a,b*, the top rear major flap 24 may be locked into place within the container 10 by placing the tab 56 into the slot 58. The signage panel 25 is then unfolded into an upright position, as shown in FIGS. 6*a,b*. FIGS. 6*a,b* illustrate the resulting container 10 in the display configuration. The contents of the container 10 are readily viewable and accessible to the user and to consumers. FIGS. 7*a*, 7*b* illustrate a product display 57 including the container 10 having beverages 59 contained therein.

Figure 8:
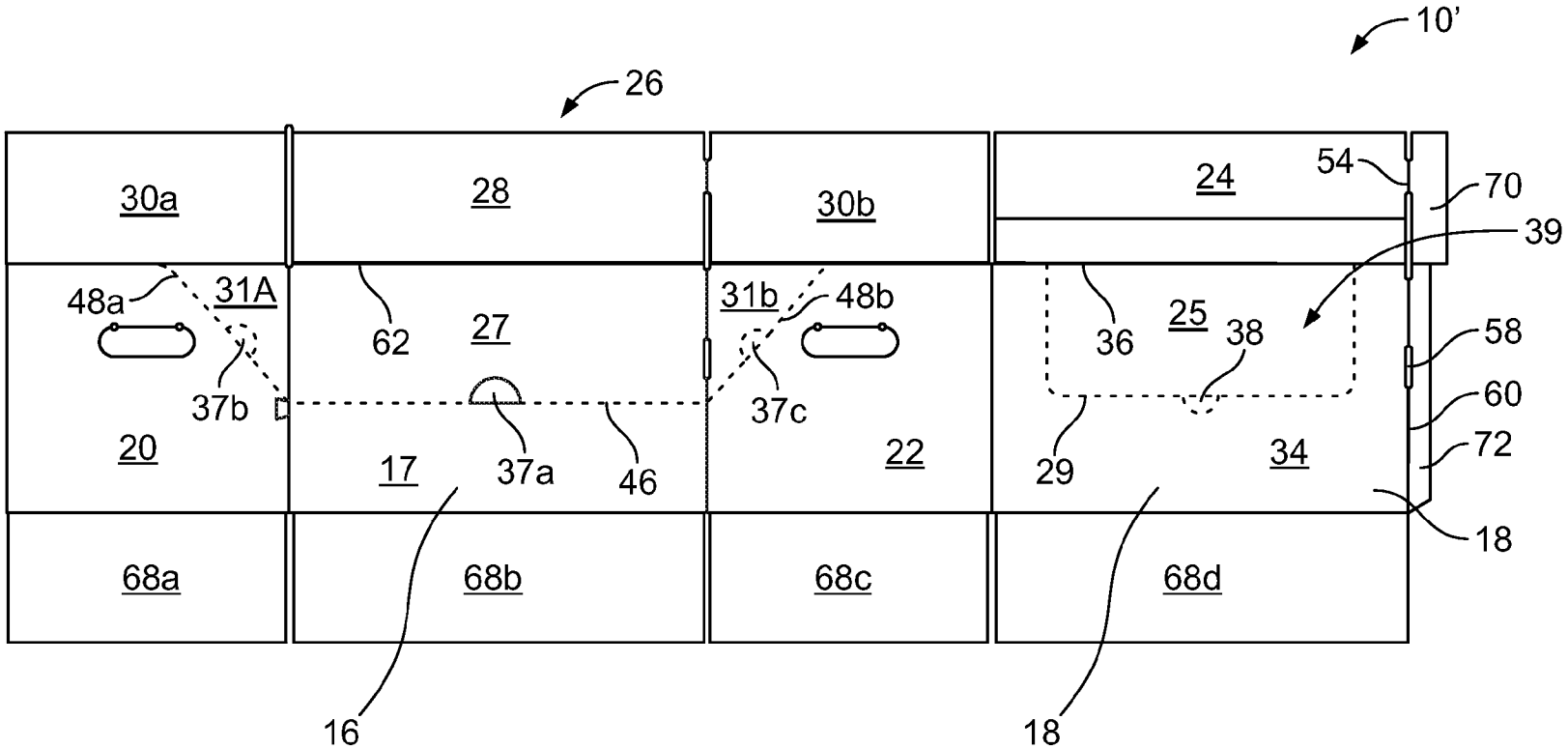
FIG. 8 is a plan view of a blank for forming the container of FIGS. 1*a*-6*b* according to one embodiment.

Turning now to FIG. 8, a plan view of a blank 10' for the formation of the container 10 of FIGS. 1*a*-6*b* is shown according to one embodiment. In addition to the panels and flaps previously described in connection with FIGS. 1*a*-6*b*, the blank 10' includes bottom flaps 68*a-d* that are used to form the bottom 33 of the container 10. The blank 10' also includes first and second overlapping panels 70, 72. In the illustrated embodiment, the overlapping panels 70, 72 extend from the top rear major flap 24 and the stationary portion 34, respectively. It is contemplated, however, that the overlapping panels 70, 72 may extend from the first side panel 20 and the first top minor flap 30*a*, respectively. When the container 10 is assembled from the blank 10', the overlapping panels 70, 72 of FIG. 8 at least partially overlap with the first side panel 20 and the first top minor flap 30*a*, respectively, and are attached or adhered thereto to form the interior 49 of the container 10 (see FIG. 4). Adhesive may be applied prior to folding or subsequent to folding.

Figure 9:
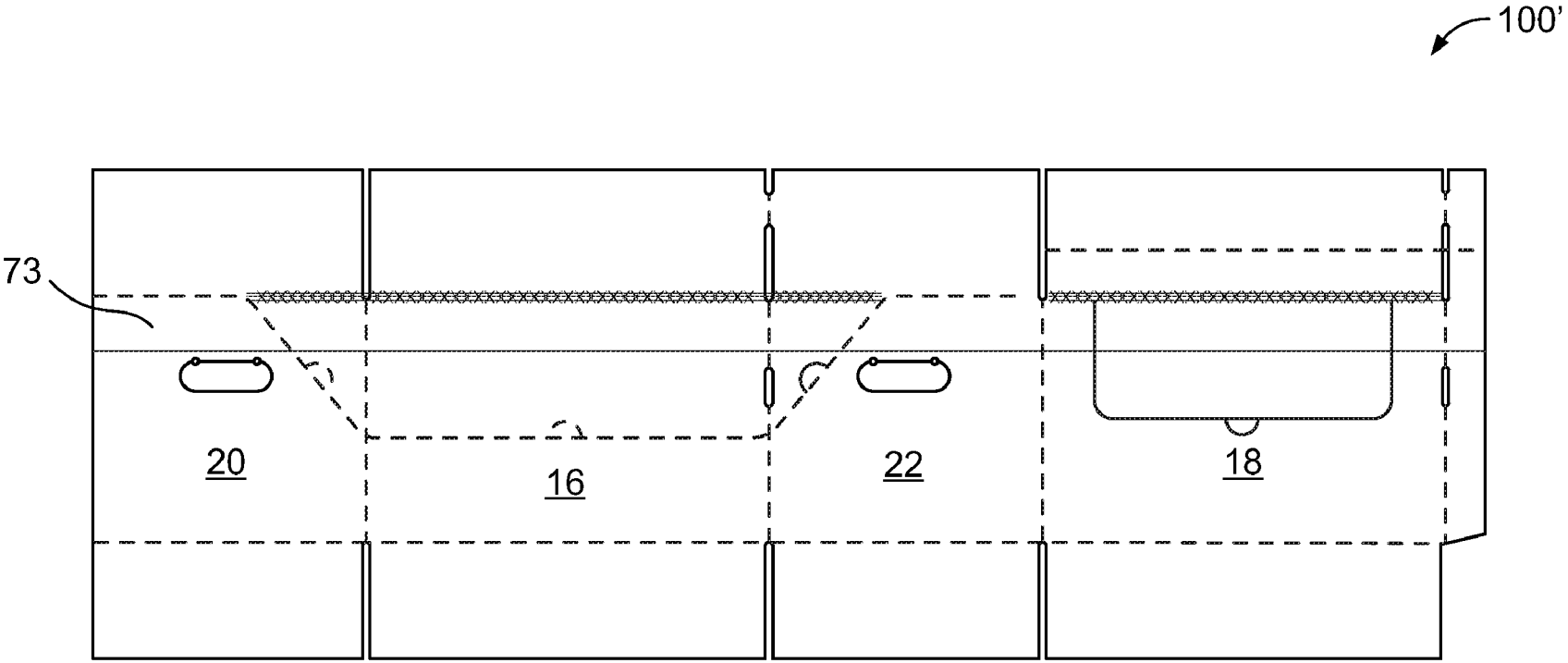
FIG. 9 is a plan view of a blank for forming the container of FIGS. 1-6*b* according to another embodiment.

FIG. 9 illustrates a blank 100' that may be used to form the container 10 of FIGS. 1*a*-6*b* according to another embodiment. The blank 100' of FIG. 9 is generally similar to the blank 10' of FIG. 8 except that the blank 100' includes sesame tape 73 positioned generally along a top edge or top portion of the first side panel 20, the front panel 16, second side panel 22, and rear panel 18. It is contemplated that the sesame tape may be positioned along another portion or other portions of the blank 100'.

The containers 10 of the embodiments described herein provide several advantages. For example, because the container 10 is formed from a single blank 10', 100' the containers of the embodiments of the present invention allow for minimal parts for inventory compared to existing comparable containers.

Moreover, the containers 10 of the embodiments described herein are aesthetically pleasing. Although graphics (see FIGS. 7*a*, 7*b*) need only be printed on one side of the blank (e.g., blank 10' of FIG. 8), a user only sees the graphic side of the container, not the unprinted side when viewing the front of the container in the display configuration. This is desirable from a marketing standpoint.

The containers of the embodiments described herein are typically manufactured using corrugated paperboard, preferably with the corrugations running in a vertical direction for increased strength. It is to be understood that the principles of this invention could be applied to containers made of other materials, such as non-corrugated paperboards, cardboard, corrugated fiberboard, non-corrugated fiberboard, solid-fiber board, polymeric materials, and other foldable materials. It is also contemplated that the container 10 may include advertising features, graphics, or the like.

Although the embodiments of the containers previously described and depicted are generally rectangular, it is contemplated that the containers of the present invention may have non-rectangular cross sections. It is contemplated that a container may have a polygonal shape, such as a triangle, square, hexagon, octagon, pentagon, or the like.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container comprising:

a front panel including a stationary front portion and a removable front portion, the stationary front portion being separated from the removable front portion by a first line of weakness;

a rear panel including a stationary rear portion and a detachable rear portion, the stationary rear portion being separated from the detachable rear portion by a second line of weakness;

a first side panel and an opposing second side panel, the first and second side panels bridging the front panel and the rear panel, the first and second side panels being separated from the removable front portion by respective third and fourth lines of weakness;

a top front major flap extending from the removable front portion, the top front major flap being hingedly coupled to the removable front portion by a first fold line;

a top rear major flap extending from the rear panel, the top rear major flap being hingedly coupled to the stationary rear portion and the detachable rear portion by a second fold line;

wherein the container is configured to be converted into a display configuration in which the removable front portion and the top front major flap are removed from the container and the top rear major flap remains coupled to the stationary rear portion.

2. The container of claim 1, wherein, when the container is converted into the display configuration, the top rear major flap is generally flush with an interior surface of the stationary rear portion of the rear panel, and the detachable rear portion of the rear panel is rotated about the second fold line into a position generally coplanar with the stationary rear portion.

3. The container of claim 1 further comprising first and second top minor flaps extending from the respective first and second side panels.

4. The container of claim 3, wherein the first and second top minor flaps are coupled to the top front major flap such that the first and second top minor flaps are removed from the container when the container is converted to the display configuration.

5. The container of claim 1, wherein the first and second side panels include diagonal portions separated from a remaining portion of the respective first and second side panels by respective lines of weakness.

6. The container of claim 5, wherein the first and second diagonal portions are coupled to the removable front portion such that the first and second diagonal portions are removed from the container when the container is converted to the display configuration.

7. The container of claim 5, wherein the removable front portion and the first and second diagonal portions include respective notches positioned along the edges thereof.

8. The container of claim 1, wherein the detachable rear portion is a signage panel.

9. The container of claim 1, wherein the container includes corrugated paperboard.

10. A container comprising:

a front panel, a rear panel, first and second side panels bridging the front panel and the rear panel, a top front flap extending from the front panel, and a top rear flap extending from the rear panel;

a removable portion including an upper section of the front panel and the top front flap, the removable portion being separable from the container along at least one lines of weakness; and a display portion including a detachable portion of the rear panel, the detachable portion being separable from the rear panel by at least one line of weakness and being hingedly coupled to the remaining portion of the rear panel and the top rear flap.

11. The container of claim 10 further comprising first and second top minor flaps extending from the respective first and second side panels.

12. The container of claim 11, wherein the first and second top minor flaps are coupled to the removable portion such that the first and second top minor flaps are removable.

13. The container of claim 10, wherein the first and second side panels include diagonal portions separated from a remaining portion of the respective first and second side panels by respective lines of weakness.

14. The container of claim 13, wherein the first and second diagonal portions are coupled to the removable portion such that the first and second diagonal portions are removable.

15. The container of claim 10, wherein the detachable portion of the rear panel is a signage panel.

16. The container of claim 10, wherein the container includes corrugated paperboard.

17. A method of using a container, the method comprising the acts of:

providing a container including a front panel, a rear panel, a first side panel, and an opposing second side panel bridging the front panel and the rear panel, a top front major flap, and a top rear major flap, the front panel including a stationary front portion and a removable front portion, the stationary front portion being separated from the removable front portion by a first line of weakness, the rear panel including a stationary rear portion and a detachable rear portion, the stationary rear portion being separated from the detachable rear portion by a second line of weakness, the first and second side panels being separated from the removable front portion by respective third and fourth lines of weakness, the top front major flap extending from the removable front portion, the top front major flap being hingedly coupled to the removable front portion by a first fold line, the top rear major flap extending from the rear panel, the top rear major flap being hingedly coupled to the stationary rear portion and the detachable rear portion by a second fold line; and converting the container from a shipper configuration to a display configuration by removing the upper front portion and the top front major panel along the first line of weakness, detaching the detachable rear portion along the second line of weakness, rotating the top rear major flap toward the interior of the container along the second fold line such that the top rear major flap is generally flush with an interior side of the stationary rear portion, and rotating the detachable rear portion about the second fold line such that the detachable rear portion is generally coplanar with the stationary rear portion.

18. The method of claim 17, wherein the detachable rear portion is a signage panel.

19. A method of using a container, the method comprising the acts of:

providing a container including a front panel, a rear panel, a first side panel, and an opposing second side panel bridging the front panel and the rear panel, a top front major flap, and a top rear major flap, the front panel including a stationary front portion and a removable front portion, the stationary front portion being separated from the removable front portion by a first line of weakness, the rear panel including a stationary rear portion and a detachable rear portion, the stationary rear portion being separated from the detachable rear portion by a second line of weakness, the first and second side panels being separated from the removable front portion by respective third and fourth lines of weakness, the top front major flap extending from the removable front portion, the top front major flap being hingedly coupled to the removable front portion by a first fold line, the top rear major flap extending from the rear panel, the top rear major flap being hingedly coupled to the stationary rear portion and the detachable rear portion by a second fold line; and converting the container from a shipper configuration to a display configuration by removing the upper front portion and the top front major panel along the first line of weakness, detaching the detachable rear portion along the second line of weakness, rotating the top rear major flap toward the interior of the container along the second fold line such that the top rear major flap is generally flush with an interior side of the stationary rear portion, and rotating the detachable rear portion about the second fold line such that the detachable rear portion is generally coplanar with the stationary rear portion wherein the container further comprises at least one tab positioned on at least one side of the top rear major flap and at least one slot positioned along a respective at least one fold line separating the rear panel from the respective first and second side panels.

20. The method of claim 19, further comprising locking the top rear major flap into place within the container in the display position by placing the tab into the slot.

* * * * *